United States Patent [19]

McGregor

[11] 4,012,858

[45] Mar. 22, 1977

[54] PRESENT CARD

[76] Inventor: Eric Robert James McGregor, "Gwern Hwlcyn", Bodfari, Clwyd, England

[22] Filed: July 25, 1975

[21] Appl. No.: 598,947

[52] U.S. Cl. ..... 40/152

[51] Int. Cl.[2] ..... G09F 1/12

[58] Field of Search ..... 40/152, 152.1, 154, 40/155, 156, 157, 158 R, 158 A, 124.1, 125 R, 158 A

[56] References Cited

UNITED STATES PATENTS

| | | | |
|---|---|---|---|
| 663,892 | 12/1901 | Hansen | 40/158 R |
| 1,982,143 | 11/1934 | Schill | 40/155 |
| 2,408,532 | 10/1946 | Roach | 40/155 |
| 2,576,667 | 11/1951 | Bly | 40/158 R X |
| 3,570,160 | 3/1971 | Spertus | 40/152 |
| 3,827,170 | 8/1974 | Lau | 40/158 R |

FOREIGN PATENTS OR APPLICATIONS

| | | | |
|---|---|---|---|
| 370,506 | 6/1923 | United Kingdom | 40/152 |

*Primary Examiner*—Louis G. Mancene
*Attorney, Agent, or Firm*—Ross, Ross & Flavin

[57] ABSTRACT

A greeting's card is given additional utility by forming one of its leaves with a perimetral frame, so that such leaf, with the other leaf attached or detached as desired, can be used as a picture frame or photograph frame.

1 Claim, 6 Drawing Figures

PRESENT CARD

BACKGROUND OF THE INVENTION

This invention concerns a present card that is to say a greetings card which, in addition to serving as a vehicle for a greetings message, is adapted to serve a secondary function so that in its functional capacity it may be regarded as a gift or a present.

In accordance with the invention there is provided a present card comprising two card leaves hingedly connected together, one of said leaves having a perimetral frame around one of its faces so that the said one of the leaves, with the other leaf detached or not as desired, can be employed as a picture frame or photograph frame, characterised in that the frame is formed by folded-over tongues provided along the four edges of the said one of the leaves.

DESCRIPTION OF THE DRAWINGS

In order that the invention may be understood, it will be described further, by way of example, with reference to the accompanying drawings, in which.

Figure 1:
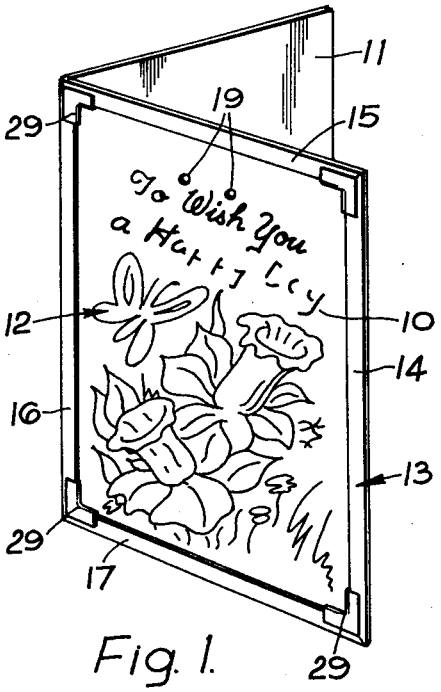
FIG. 1 is a perspective view of a preferred embodiment of the present card of the invention.

The illustrated preferred embodiment of the present card of the invention comprises two card leaves 10 and 11 which are hingedly connected together along side edges thereof. The outer face of the leaf 10 bears any suitable design, with or without wording or annotation, as has been indicated generally by reference numeral 12; further, the inner face of such leaf 10 bears an appropriate greeting or message as has been indicated diagrammatically in FIGS. 3 and 4. Naturally, the inner face of the leaf 11, may if desired, also bear a greeting or message, but since this leaf 11 may be detached and discarded (as will later be described) any printed or other words or message should preferably appear on the inner face of the leaf 10.

Figure 2:
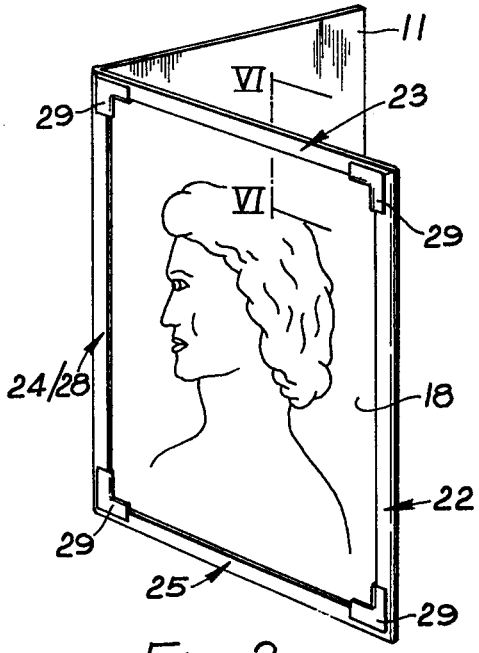
FIG. 2 is a view similar to FIG. 1, but showing the present card with a photograph in position.
Figure 5:
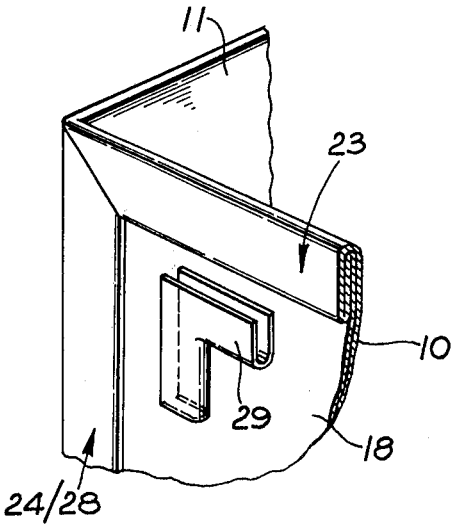
FIG. 5 is an enlarged fragmentary detail showing part of the present card of FIGS. 1 to 4 with a photograph or the like inserted in position therein, and showing a corner-interlocking element of the card ready to be assembled in place.
Figure 6:
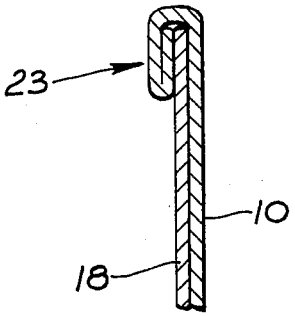
FIG. 6 is a section taken on the line VI—VI of FIG. 2.

Secured to the perimeter of the outer face of the leaf 10 is a perimetral frame, indicated in FIG. 1 generally by the reference numeral 13. This frame 13 is composed of four strips 14, 15, 16 and 17 each extending along a respective edge of the leaf 10 and spaced away from the confronting outer face of the leaf 10 to define a gap therebetween. These gaps accordingly define, all around the leaf 10, a slot or channel into which the perimetral edges of a photograph 18 (or other sheet or cardlike member desired to be displayed) can be inserted, as shown in FIGS. 2, 5 and 6.

Figure 3:
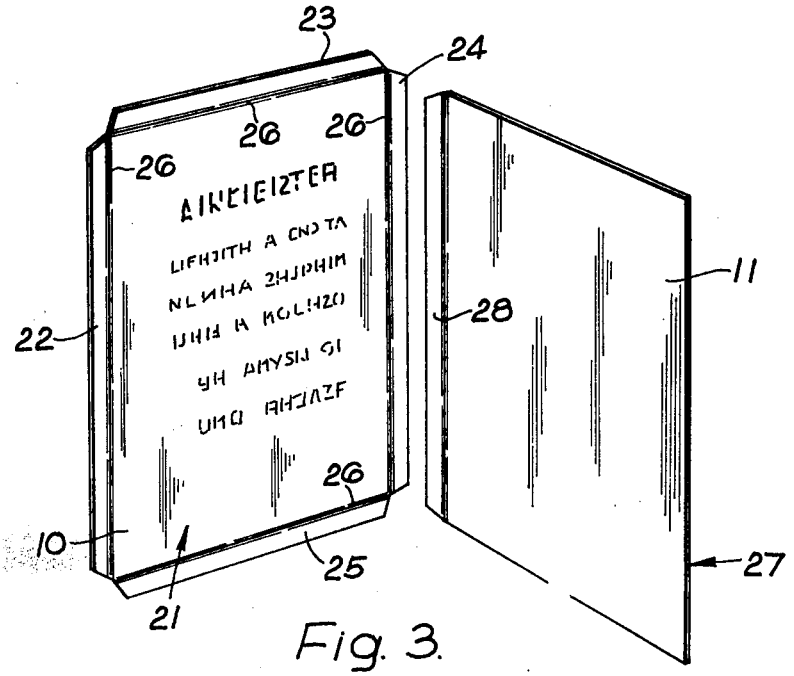
FIG. 3 is a perspective view illustrating two of the components of the embodiment of FIG. 2.
Figure 4:
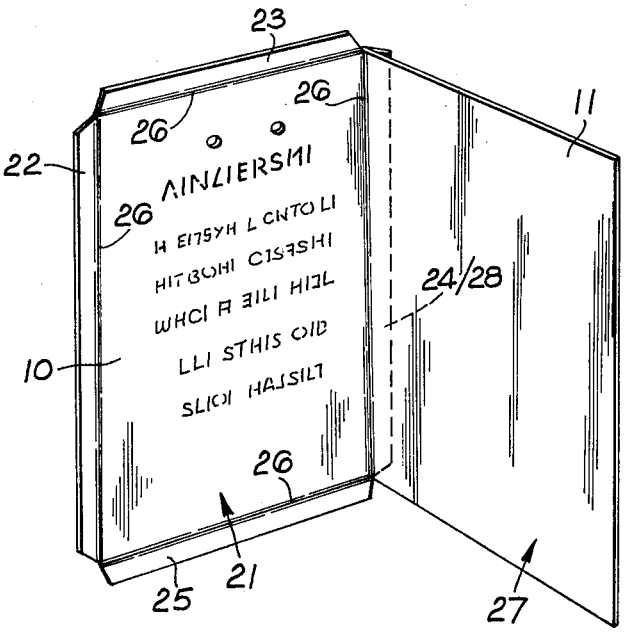
FIG. 4 is a view comparable with FIG. 3, but showing the components connected together.

The frame 13 is formed largely by card components formed integrally with the leaf 10. In making the present card, as shown in FIG. 3 one starts with a blank 21 shaped to provide the rectangular leaf 10 having integral tongues 22, 23, 24 and 25 respectively along its edges, these joining with the leaf 10 by score lines 26, as well as a blank 27 shaped to provide the leaf 11 having a single tongue 28 along one longer edge thereof. The tongue 28 is of shape and dimensions corresponding to the tongue 24 of the blank 21 and these two tongues are each preferably reduced in thickness (e.g. by compression or shaving away part of the material thereof) so as to be about one half the thickness of the tongues 22, 23 and 25. The two blanks 21 and 27 are then secured together by adhering the tongues 24 and 28 togehter as shown in FIG. 4. This, therefore, provides a card comprising the two leaves 10 and 11 of which the leaf 10 effectively has the four tongues 22, 23, 24/28, and 25.

These latter tongues serve to form the frame 13 around the leaf 10. As can be seen from FIGS. 5 and 6, this is achieved by firstly folding each of the tongues longitudinally, and then folding such folded tongues along their score lines 26 to overlie the outer face of the leaf 10. This is preferably done after the photograph or the like 18 has been placed in position against the outer face of the leaf 10. The condition illustrated in FIGS. 5 and 6 is thereby achieved. To ensure that the doubly foldedover tongues remain in their positions forming the frame 13 around the leaf 10, as is shown in FIGS. 5, 2 and 1, respective channel-sectioned corner pieces 29 are slid into position to engage with the adjacent ends of the tongues at each corner of the leaf 10. These corner pieces 29, which may be moulded of relatively stiff resilient plastics, are preferably dimensioned to grip tightly with the respective tongues, thereby to ensure that they stay reliably in position and firmly hold the tongues in their desired configuration forming the frame 13.

In using the present card, the purchaser can despatch the same in the normal way after adding, if desired, a signature and any other required additional manuscript message to whatever is printed on the inner face of the leaf 10, as is customary for conventional greetings cards. The recipient can, also, put the card on display, precisely in the form received, again as is customary.

With traditional greetings cards, after they have been on display for a few days it is usual for the card either to be put away and forgotten or to be thrown away. The described card, however, has a utilitarian function over and above its normal function as a vehicle for a message or greeting, so that it no longer becomes an unwanted trifle, or forgotten souvenir after it has been taken down from display, but can be put to useful purpose.

To achieve this, the recipient makes use of the presence of the frame 13, which in fact converts the leaf 10 into a photograph frame, by inserting into such frame 13 the photograph or other sheet or card-like member 18 required to be exhibited or displayed. The framed photograph or the like can then be stood up on a table, desk, sideboard or other location as desired, making use of the leaf 11 to impart stability thereto. If the framed photograph or the like is required to be hung, the leaf 11 can be detached carefully along its hinge connection with the leaf 10 and discarded, and use can be made of a cord or string (not shwon) through holes 19 in the leaf 10 for the hanging. Naturally, such cord or string should be threaded through the holes 19 before the photograph or the like 18 is inserted in position.

It will be understood, of course, that the user of the present card can, if desired, insert a photograph or other card into the frame 13, if he so desired, before despatching the same.

The invention is not confined to the precise details of the foregoing examples and variations may be made thereto. For instance the frame 13 can, if desired, hold a glass panel, not shown, in position over the leaf 10, and the hinge between the leaves 10 and 11 may advantageously incorporate a score line or perforation line, facilitating detachment of the leaf 11 from the leaf 10. Other variations are, of course, possible.

I claim:

1. A greeting card picture framing kit comprising: a first substantially rectangular element having a tongue pivotally attached to each edge thereof, the tongue being adapted to be folded so as to overlie the planar face of the element, a second substantially rectangular element having a tongue pivotally attached to an edge thereof and of a size equal to one of the tongues on the first rectangular element whereby the rectangular elements can be juxtaposed with the two tongues superposed, means for removably adhering said two juxtaposed tongues the second element adapted to be removed from the first element so as to leave four tongues unobstructed along the edges of the first element, molded corner pieces each having an external U shaped cross section, the corner pieces being adapted to serve as internal corner pieces for any two folded over contiguous tongues, thereby providing a self contained picture frame.

* * * * *